US011337279B2

(12) United States Patent
Kwack et al.

(10) Patent No.: US 11,337,279 B2
(45) Date of Patent: May 17, 2022

(54) METHOD FOR SENSING CONTAINER USING RESONANT CURRENT

(71) Applicant: LG ELECTRONICS INC., Seoul (KR)

(72) Inventors: Younghwan Kwack, Seoul (KR); Seongho Son, Seoul (KR); Jaekyung Yang, Seoul (KR); Yongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 600 days.

(21) Appl. No.: 16/390,686

(22) Filed: Apr. 22, 2019

(65) Prior Publication Data

US 2020/0029398 A1 Jan. 23, 2020

(30) Foreign Application Priority Data

Jul. 18, 2018 (KR) ..... 10-2018-0083729
Nov. 20, 2018 (KR) ..... 10-2018-0143997

(51) Int. Cl.
*H05B 6/06* (2006.01)
*H05B 6/12* (2006.01)

(52) U.S. Cl.
CPC ..... *H05B 6/062* (2013.01); *H05B 6/1209* (2013.01); *H05B 6/1236* (2013.01)

(58) Field of Classification Search
CPC .... H05B 6/062; H05B 6/1236; H05B 6/1209; H05B 2213/05
See application file for complete search history.

(56) References Cited

U.S. PATENT DOCUMENTS

2009/0120928 A1 5/2009 Lee et al.
2012/0305546 A1 12/2012 Filippa et al.

FOREIGN PATENT DOCUMENTS

EP 2059091 5/2009
EP 2533605 12/2012
WO WO2013064331 5/2013

OTHER PUBLICATIONS

Extended European Search Report in European Application No. 19165194.2, dated Oct. 14, 2019, 9 pages.

*Primary Examiner* — Dana Ross
*Assistant Examiner* — Kuangyue Chen
(74) *Attorney, Agent, or Firm* — Fish & Richardson P.C.

(57) ABSTRACT

A method for sensing a container includes: charging an induction heating circuit; sensing a current applied to the induction heating circuit, converting a current value of the current into a first voltage value; comparing the first voltage value with a resonance reference value; generating a resonance of the current; sensing a resonant current generated in the induction heating circuit; converting the resonant current into a second voltage value; comparing the second voltage value with a count reference value; generating one or more output pulses; comparing a count of the one or more output pulses with a reference count, or comparing an on-duty time of the one or more output pulses with a reference time; and based on (i) the comparison of the count with the reference count or (ii) the comparison of the on-duty time with the reference time, determining whether an object is present on a working coil.

20 Claims, 12 Drawing Sheets

METHOD FOR SENSING CONTAINER USING RESONANT CURRENT

CROSS-REFERENCE TO RELATED APPLICATIONS

This application claims priority under 35 U.S.C. § 119 to Korean Application No. 10-2018-0083729, filed on Jul. 18, 2018, and Korean Application No. 10-2018-0143997, filed on Nov. 20, 2018. The disclosures of the prior applications are incorporated by reference in their entirety.

TECHNICAL FIELD

The present disclosure relates to a method for sensing a container using a resonant current.

BACKGROUND

An induction heating device may cause a high-frequency current to flow in a working coil or a heating coil. The high-frequency current may generate a strong magnetic field line. In some cases, when the magnetic field line passes through a cooking container placed on the heating coil, an eddy current may be generated in the cooking container.

For example, as a current is applied to the heating coil, an induction heating phenomenon may occur in the cooking container made of a magnetic material. Heat generated by induction heating may increase a temperature of the cooking container.

A recent induction heating device has a container sensing function to sense whether or not the cooking container is present on the heating coil.

Hereinafter, an induction heating device in related art will be described.

FIG. 1 illustrates an induction heating device having a container sensing function in related art.

Referring to FIG. 1, the induction heating device includes a power supply unit 61, a switching unit 62, a working coil 63, a zero-point detection unit 64, a control unit 65, and a current conversion unit 66.

Specifically, the power supply unit 61 supplies a direct current (DC) to the switching unit, and the switching unit 62 supplies a resonant current to the working coil through a switching operation. The zero-point detection unit 64 detects a zero-point of commercial power and transmits a zero-point signal to the control unit 65. The current conversion unit 66 measures a resonant current flowing through the working coil 63 and transmits a voltage fluctuation waveform to the control unit 65. The control unit 65 controls an operation of the switching unit 62 based on the zero-point signal and the voltage fluctuation waveform supplied from the zero-point detection unit 64 and the current conversion unit 66, respectively.

The control unit 65 calculates a voltage value based on the supplied zero-point signal and the voltage fluctuation waveform. In some implementations, when the calculated voltage value deviates from a predetermined variation range, the control unit 65 determines that no container 70 is present on the working coil 63.

In some cases, the induction heating device may determine whether or not the container 70 is present on the working coil 63 only at a zero-point time point (i.e., zero-voltage time point) of an input voltage (i.e., commercial power). In this case, accuracy in sensing a container may be low, and power consumption may be high.

In some cases, when the input voltage outputted from the power supply unit 61 is changed, the induction heating device may not accurately sense a container. For example, when an adjacent working coil operates, an input voltage applied to a working coil to be sensed may be lowered. In this case, accuracy in sensing a cooking container may be lowered.

SUMMARY

The present disclosure provides a method for sensing a container by an induction heating device configured to operate with low power consumption and respond rapidly.

The present disclosure further provides a method for sensing a container by an induction heating device that may stably perform a container sensing operation regardless of whether or not an adjacent working coil operates or a change in input power.

According to one aspect of the subject matter described in this application, a method is disclosed for sensing a container by an induction heating device. The induction heating device includes a switch driving unit, an induction heating circuit configured to drive a working coil by an inverter unit, a sensor configured to sense current applied to the induction heating circuit, a resonant current conversion unit configured to convert current values to voltage values, a shutdown comparison unit, a shutdown circuit unit configured to control the switch driving unit, a count comparison unit, and a control unit configured to determine presence of the container on the working coil. The method includes: charging, by controlling the inverter unit through the switch driving unit, the induction heating circuit; sensing, by the sensor, a current applied to the induction heating circuit; converting, by the resonant current conversion unit, a current value of the current into a first voltage value; comparing, by the shutdown comparison unit, the first voltage value with a predetermined resonance reference value; based on the first voltage value being greater than the predetermined resonance reference value, generating a resonance of the current by controlling the switch diving unit through the shutdown circuit unit; based on generation of the resonance, sensing, by the sensor, a resonant current generated in the induction heating circuit; converting, by the resonant current conversion unit, a current value of the resonant current into a second voltage value; comparing, by the count comparison unit, the second voltage value with a predetermined count reference value; generating, by the count comparison unit, one or more output pulses based on a result of the comparison of the second voltage value with the predetermined count reference value; comparing, by the control unit, a count of the one or more output pulses with a predetermined reference count, or comparing, by the control unit, an on-duty time of the one or more output pulses with a predetermined reference time; and based on (i) a result of the comparison of the count of the one or more output pulses with the predetermined reference count or (ii) a result of the comparison of the on-duty time of the one or more output pulses with the predetermined reference time, determining, by the control unit, whether or not an object is present on the working coil.

Implementations according to this aspect may include one or more of the following features. For example, controlling the inverter unit may include: based on a switching signal supplied from the switch driving unit, turning on and turning off a first switching element and a second switching element of the inverter unit. In some examples, charging the induction heating circuit may include: charging the induction heating circuit based on turning on the first switching element and turning off the second switching element. In some examples, generating the resonance of the current may include: generating the resonance of the current based on turning off the first switching element and turning on the second switching element.

In some implementations, generating the resonance of the current may include: maintaining an output signal of the shutdown comparison unit in an activated state for a predetermined period of time. In some examples, generating the one or more output pulses may include: generating a pulse corresponding to an on-state based on the second voltage value being greater than the predetermined count reference value; and generating a pulse corresponding to an off-state based on the second voltage value being less than the predetermined count reference value.

In some examples, the method further includes determining the count based on a number of times at which the one or more output pulses are switched from the off-state to the on-state. In these examples, determining whether or not the object is present on the working coil may include: determining that the object is present on the working coil based on the count being less than the predetermined reference count, and determining that the object is not present on the working coil based on the count being greater than the predetermined reference count.

In some examples, the method further includes determining the on-duty time based on an accumulated time of the on-state of the one or more output pulses. In these examples, determining whether or not the object is present on the working coil may include: determining that the object to be heated is present on the working coil based on the on-duty time being less than the predetermined reference time, and determining that the object is not present on the working coil based on the on-duty time being greater than the predetermined reference time.

In some implementations, the method may further include: receiving, at the control unit, a voltage applied to the inverter unit; outputting, from the control unit, a first single pulse having a first on-state duration based on a variation amount of the voltage being less than a predetermined variation reference value; and outputting, from the control unit, a second single pulse having a second on-state duration greater than the first on-state duration based on the variation amount of the voltage being greater than the predetermined variation reference value. In some examples, charging the inducting heating circuit may include supplying a single pulse having the first on-state duration or the second on-state duration to the shutdown circuit unit.

In some implementations, determining whether or not the object is present on the working coil may include determining whether or not the object is present on the working coil in a state in which a voltage applied to the inverter unit is less than a predetermined reference voltage. In some implementations, determining whether or not the object is present on the working coil may include: based on an induction current induced to the working coil by operation of another working coil disposed within a range from the working coil, determining whether or not the object is present on the working coil in a state in which the induction current is less than a predetermined reference current.

In some implementations, the method may further include generating, by the shutdown comparison unit, an output signal based on the first voltage value being greater than the predetermined resonance reference value. In some examples, the method may further include: supplying a pulse signal to the shutdown circuit unit; and based on the pulse signal, transmitting the output signal from the shutdown circuit unit to the switch driving unit. In some examples, the method may further include generating, by the switch driving unit, the switching signal based on the output signal received from the shutdown circuit unit. In some implementations, charging the inducting heating circuit may include charging the inducting heating circuit with energy having a constant magnitude.

According to another aspect, a method is disclosed for sensing a container by an induction heating device. The induction heating device includes a switch driving unit, an induction heating circuit configured to drive a working coil by an inverter unit, a sensor configured to sense current applied to the induction heating circuit, a resonant current conversion unit configured to convert current values to voltage values, a shutdown comparison unit, a shutdown circuit unit configured to control the switch driving unit, a count comparison unit, and a control unit configured to determine presence of the container on the working coil. The method includes: charging, by controlling the inverter unit through the switch driving unit, the induction heating circuit; sensing, by the sensor, a current applied to the induction heating circuit; converting, by the resonant current conversion unit, a current value of the current into a first voltage value; comparing, by the shutdown comparison unit, the first voltage value with a predetermined resonance reference value; based on the first voltage value being greater than the predetermined resonance reference value, generating a resonance of the current by controlling the switch diving unit through the shutdown circuit unit; based on generation of the resonance, sensing, by the sensor, a resonant current applied to the induction heating circuit; converting, by the resonant current conversion unit, a current value of the resonant current measured by the sensor into a second voltage value; comparing, by the count comparison unit, the second voltage value with a predetermined count reference value; generating, by the count comparison unit, one or more output pulses based on a result of the comparison of the second voltage value with the predetermined count reference value; comparing, by the control unit, a count of the one or more output pulses with a predetermined reference count, or comparing, by the control unit, an on-duty time of the one or more output pulses with a predetermined reference time; and based on (i) a result of the comparison of the count of the one or more output pulses with the predetermined reference count or (ii) a result of the comparison of the on-duty time of the one or more output pulses with the predetermined reference time, determining, by the control unit, whether or not an object is present on the working coil. Charging the inducting heating circuit includes: receiving, at the control unit, a voltage applied to the inverter unit; outputting, from the control unit, a first single pulse having a first on-state duration based on a variation amount of the voltage being less than a predetermined variation reference value; and outputting, from the control unit, a second single pulse having a second on-state duration greater than the first on-state duration based on the variation amount of the voltage being greater than the predetermined variation reference value.

Implementations according to this aspect may include one or more of the following features or the features described above. For example, generating the one or more output pulses may include: generating a pulse corresponding to an on-state based on the second voltage value being greater than the predetermined count reference value; and generating a pulse corresponding to an off-state based on the second voltage value being less than the predetermined count reference value.

In some examples, the method may further include determining the count based on a number of times at which the one or more output pulses are switched from the off-state to the on-state. In these examples, determining whether or not the object is present on the working coil may include: determining that the object is present on the working coil based on the count being less than the predetermined reference count; and determining that the object is not present on the working coil based on the count being greater than the predetermined reference count.

In some examples, the method may further include determining the on-duty time based on an accumulated time for the on-state of the one or more output pulses. In these examples, determining whether or not the object is present on the working coil may include: determining that the object to be heated is present on the working coil based on the on-duty time being less than the predetermined reference time; and determining that the object is not present on the working coil based on the on-duty time being greater than the predetermined reference time.

The present disclosure are not limited to the above-described aspects, and the other aspects and advantages of the present disclosure will become apparent from the following description of implementations. In addition, it is easily understood that the aspects and advantages of the present disclosure can be achieved by the means described in the claims and a combination thereof.

In some implementations, the method for sensing a container by the induction heating device may include a step of determining whether or not an object to be heated is present by using a single pulse in a particular section based on a zero-crossing time point, thereby reducing power consumption and improving a response characteristic.

In some implementations, the method for sensing a container by the induction heating device may include a step of adjusting a length of the single pulse according to a variation amount of the input voltage, thereby stably performing the container sensing operation.

In some implementations, it may be possible to reduce power consumption and improve a response characteristic through the method for sensing a container by the induction heating device, thereby preventing waste of electric power and improving a user's satisfaction.

In some implementations, it may be possible to stably perform the container sensing operation regardless of whether or not an adjacent working coil operates or a change in input power through the method for sensing a container by the induction heating device, thereby improving the accuracy and operation reliability of the container sensing function. In addition, the method for sensing a container by the induction heating device may prevent an over-current from flowing when performing the container sensing function, thereby preventing a noise resulting from the over-current.

In addition to the above described effect, a specific effect of the present disclosure will be described together with a specific matter for implementing the disclosure.

DETAILED DESCRIPTION

Figure 1:
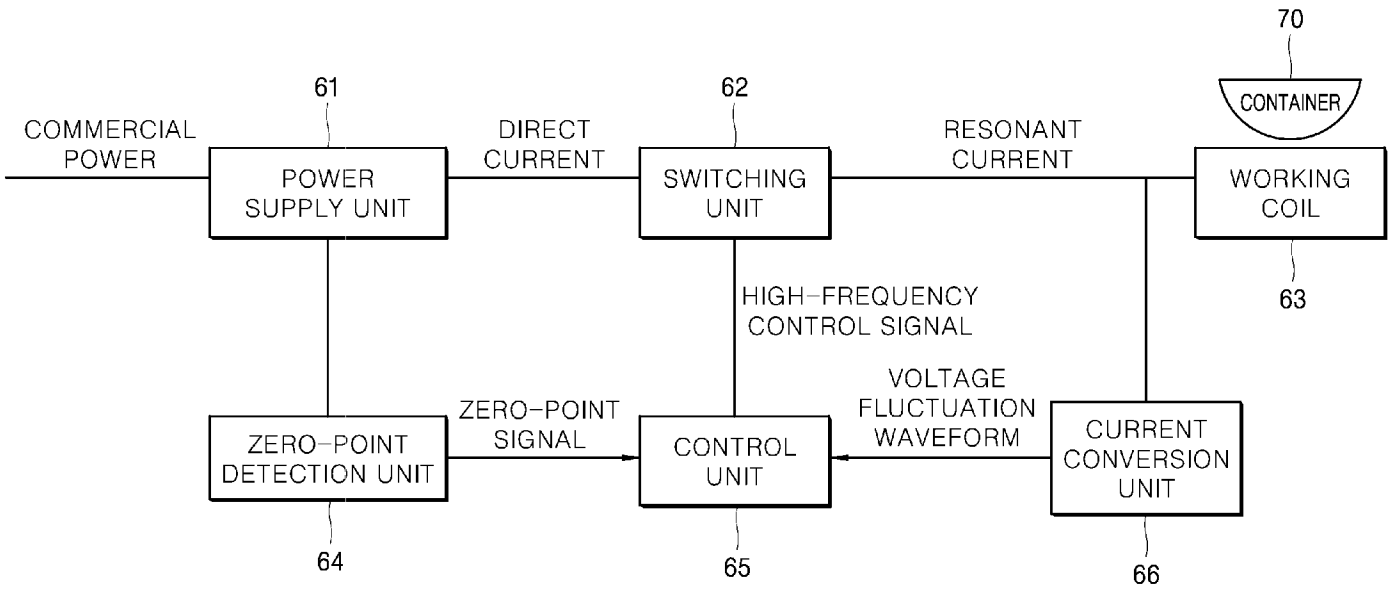
FIG. 1 Related Art
FIG. 1 is a block diagram illustrating an induction heating device in related art.

The above-described aspects, features and advantages will be described in detail with reference to the accompanying drawings so that those skilled in the art can easily carry out the present disclosure. In relation to describing the present disclosure, the detailed description of well-known related configurations or functions can be omitted when it is deemed that such description may cause ambiguous interpretation of the present disclosure. Hereinafter, one or more implementations according to the present disclosure will be described with reference to the accompanying drawings. Same or like reference numerals designate same or like components throughout the specification.

Further, it should be noted that, when it is described in the specification that one component is "connected," "coupled" or "joined" to another component, the former may be directly "connected," "coupled," and "joined" to the latter or "connected," "coupled," and "joined" to the latter via another component.

Hereinafter, a method for sensing a container performed by an induction heating device will be described in detail with reference to FIGS. 2 to 12B.

Figure 2:
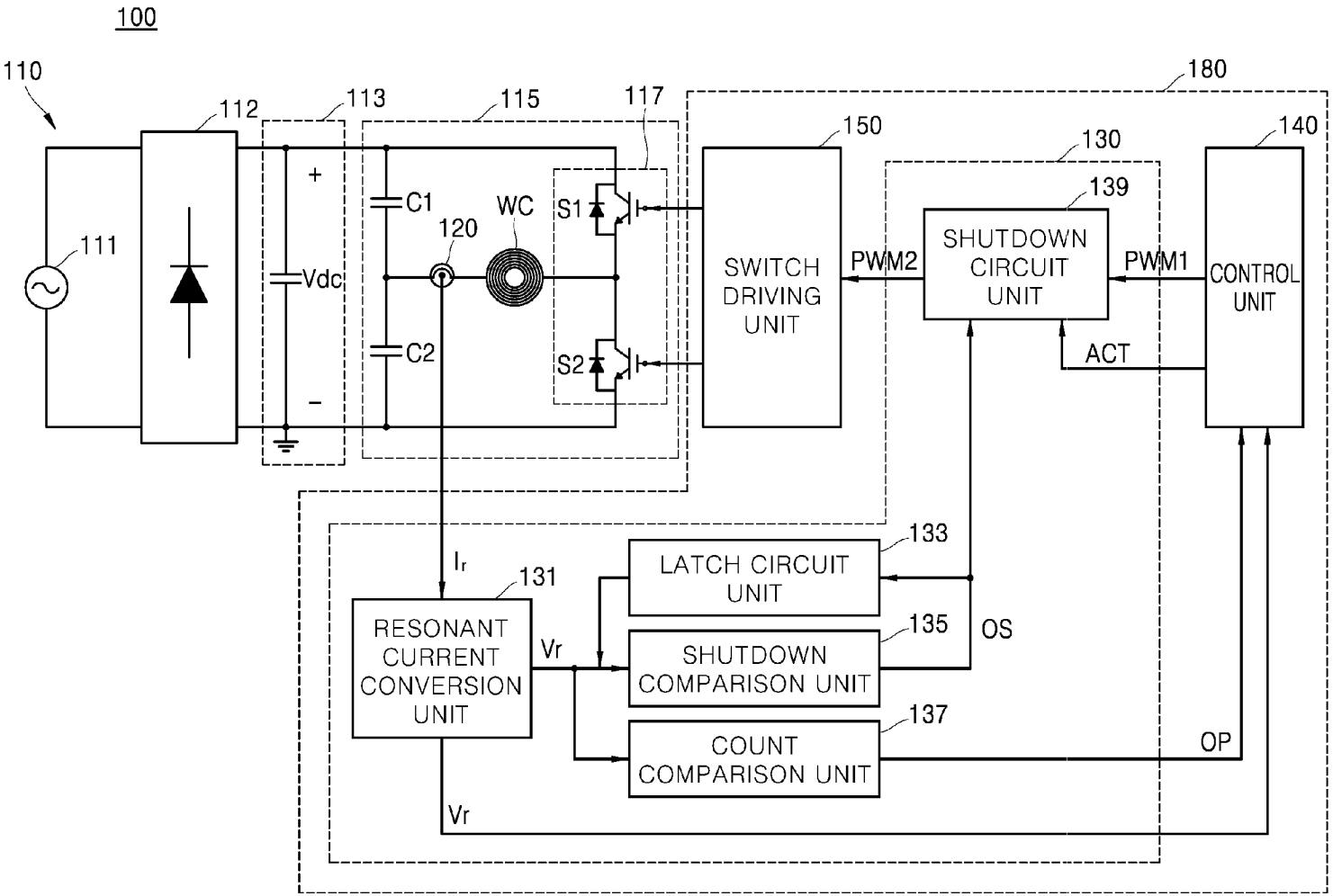
FIG. 2 is a schematic diagram illustrating an induction heating device according to an implementation of the present disclosure.

FIG. 2 is a schematic diagram illustrating an example induction heating device according to an implementation of the present disclosure.

Referring to FIG. 2, an induction heating device 100 may include an induction heating circuit 110 configured to drive a working coil WC, a sensor configured to measure a current flowing through the working coil WC, and a controller 180 configured to control the induction heating circuit 110 based on the current measured by the sensor 120.

In some implementations, the induction heating circuit 110 may include a power supply unit 111, a rectification unit 112, a direct current (DC) link capacitor 113, and an induction heating unit 115.

The power supply unit 111 may output alternating current (AC) power.

Specifically, the power supply unit 111 may output and supply the AC power to the rectification unit 112, and may be a commercial power source, for example.

The rectification unit 112 may convert the AC power supplied from the power supply unit 111 into DC power and supply the DC power to an inverter unit 117.

Specifically, the rectification unit 112 may rectify the AC power supplied from the power supply unit 111 and convert the rectified AC power into DC power. Also, the rectification unit 112 may supply the converted DC power to the DC link capacitor 113.

In some examples, the rectification unit 112 may include a bridge circuit composed of one or more diodes, but is not limited thereto.

The DC link capacitor 113 may receive the DC power from the rectification unit 112, and may reduce a ripple of the received DC power. The DC link capacitor 113 may also include a smoothing capacitor, for example.

In addition, the DC link capacitor 113 may receive the DC power from the rectification unit 112, and thus, a DC voltage Vdc (hereinafter, referred to as an input voltage) may be applied to opposite ends of the DC link capacitor 113.

As a result, the DC power (or DC voltage) that is rectified by the rectification unit 112 and has a ripple reduced by the DC link capacitor 113 may be supplied to the inverter unit 117.

The induction heating unit 115 may drive the working coil WC.

Specifically, the induction heating unit 115 may include the inverter unit 117 and a resonant capacitor unit (i.e., C1 and C2).

In some implementations, the inverter unit 117 may include two switching elements S1 and S2. The first and second switching elements S1 and S2 may be alternately turned on or off by a switching signal supplied from a switch driving unit 150 to convert the DC power into a high-frequency AC (that is, a resonant current). As a result, the converted high-frequency AC may be supplied to the working coil WC.

In some examples, the first and second switching elements S1 and S2 may include, for example, an insulated gate bipolar transistor (IGBT), but are not limited thereto.

The resonant capacitor unit may include first and second resonant capacitors C1 and C2 respectively connected in parallel to the first and second switching elements S1 and S2.

Specifically, when a voltage is applied by a switching operation of the inverter unit 117, the resonant capacitor units C1 and C2 may begin to resonate. When the resonant capacitor units C1 and C2 resonate, a current flowing through the working coil WC connected to the resonant capacitor units C1 and C2 may rise.

Through this process, an eddy current may be induced to an object to be heated (for example, a cooking container) disposed on the working coil WC connected to the resonant capacitor units C1 and C2.

In some examples, the working coil WC may include, for example, at least one of a single coil structure composed of a single coil, a dual coil structure separated into an inner coil and an outer coil, and a multi-coil structure composed of a plurality of coils.

The sensor 120 may measure a current value Ir of the current flowing through the working coil WC.

Specifically, the sensor 120 may be connected in series with the working coil WC, and may measure the current value Ir of the current flowing through the working coil WC.

In some examples, the sensor 120 may include, for example, a current measuring sensor configured to directly measure the current value of the current, or may include a current transformer.

When the sensor 120 includes the current measuring sensor, the sensor 120 may directly measure the current value Ir of the current flowing through the working coil WC and supply the measured current value Ir to a resonant current conversion unit 131 to be described later. When the sensor 120 includes the current transformer, the sensor 120 may convert a magnitude of the current flowing through the working coil WC via the current transformer and supply the current having the converted magnitude to the resonant current conversion unit 131.

But, for ease of explanation, in the present disclosure, a configuration in which the sensor 120 includes the current measuring sensor configured to directly measure the current value Ir of the current flowing through the working coil WC will be described as an example.

The controller 180 may include a container sensing unit 130, a control unit 140, and a switch driving unit 150.

In some implementations, the container sensing unit 130 may determine a state of a second pulse signal PWM2 (in particular, PWM2-HIN of FIG. 3) to be supplied to the switch driving unit 150 based on the current value of the current measured by the sensor 120.

The container sensing unit 130 may include the resonant current conversion unit 131, latch circuit unit 133, shutdown comparison unit 135, count comparison unit 137, and shutdown circuit unit 139.

Specifically, the resonant current conversion unit 131 may convert the current value Ir of the current measured by the sensor 120 into a voltage value Vr. The resonant current conversion unit 131 may also transmit the converted voltage value Vr to each of the shutdown comparison unit 135, the count comparison unit 137 and the control unit 140.

That is, the resonant current conversion unit 131 may convert the current value Ir of the current supplied from the sensor 120 into the voltage value Vr, and may transmit the converted voltage value Vr to each of the shutdown comparison unit 135, the count comparison unit 137 and the control unit 140.

Here, the voltage value supplied to the shutdown comparison unit 135 by the resonant current conversion unit 131 may be different from the voltage value supplied to the count comparison unit 137 by the resonant current conversion unit 131, and details thereof will be described later.

In some examples, the resonant current conversion unit 131 is not an essential component, and thus may be omitted. In this case, the current value Ir of the current measured by the sensor 120 may be transmitted to the shutdown comparison unit 135, the count comparison unit 137 and the control unit 140.

But, for ease of explanation, in the present disclosure, a configuration in which the resonant current conversion unit 131 is included in the induction heating device 100 will be described as an example.

The shutdown comparison unit 135 may compare whether or not the voltage value Vr supplied from the resonant current conversion unit 131 is greater than a predetermined resonance reference value Vr_ref.

Specifically, the shutdown comparison unit 135 may compare the voltage value Vr supplied from the resonant current conversion unit 131 with the predetermined resonance reference value Vr_ref.

That is, when the voltage value Vr supplied from the resonant current conversion unit 131 is greater than the predetermined resonance reference value Vr_ref, the shutdown comparison unit 135 may activate an output signal OS. On the other hand, when the voltage value Vr supplied from the resonant current conversion unit 131 is less than the predetermined resonance reference value Vr_ref, the shutdown comparison unit 135 may deactivate the output signal OS.

Here, activating the output signal OS may mean outputting the output signal OS at a high level (for example, "1"), and deactivating the output signal OS may mean outputting the output signal OS at a low level (for example, "0").

The output signal OS of the shutdown comparison unit 135 may be supplied to the shutdown circuit unit 139.

The state of the second pulse signal PWM2 (in particular, PWM2-HIN of FIG. 3) outputted from the shutdown circuit unit 139 may be determined according to whether or not the output signal OS is activated, and details thereof will be described later.

The latch circuit unit 133 may maintain an activation state of the output signal OS outputted from the shutdown comparison unit 135 for a predetermined period of time.

Specifically, when the output signal OS of the shutdown comparison unit 135 is activated, the latch circuit unit 133 may maintain the activation state of the output signal OS outputted from the shutdown comparison unit 135 for a predetermined period of time.

The count comparison unit 137 may compare whether or not the voltage value Vr supplied from the resonant current conversion unit 131 is greater than a predetermined count reference value Vcnt_ref, and may output one or more output pulses OP based on a result of comparison.

Specifically, when the voltage value Vr supplied from the resonant current conversion unit 131 is greater than the predetermined count reference value Vcnt_ref, the count comparison unit 137 may output the one or more output pulses OP that is in an on-state.

In some examples, when the voltage value Vr supplied from the resonant current conversion unit 131 is less than the predetermined count reference value Vcnt_ref, the count comparison unit 137 may output the one or more output pulses OP that is in an off-state.

Here, the one or more output pulses OP that is in the on-state may have a logic value of "1," and the one or more output pulses OP that is in the off-state may have a logic value of "0."

Accordingly, the one or more output pulses OP outputted from the count comparison unit 137 may be in the form of a square wave in which the on-state and off-state are repeated.

In some examples, the one or more output pulses OP outputted from the count comparison unit 137 may be supplied to the control unit 140.

Accordingly, the control unit 140 may determine whether or not an object to be heated is present on the working coil WC based on a count or on-duty time of the one or more output pulses OP supplied from the count comparison unit 137.

The shutdown circuit unit 139 may supply the second pulse signal PWM2 for a container sensing operation to the switch driving unit 150.

Specifically, the shutdown circuit unit 139 may supply the second pulse signal PWM2 to the switch driving unit 150, and the switch driving unit 150 may complementarily turn on or off the first and second switching elements S1 and S2 included in the inverter unit 117 based on the second pulse signal PWM2.

Here, the second pulse signal PWM2 may include a signal (PWM2-HIN of FIG. 3) configured to control turning on or turning off of the first switching element S1 and a signal (PWM2-LIN of FIG. 3) configured to control turning on or turning off of the second switching element S2

In some examples, the state of the second pulse signal PWM2 (in particular, PWM2-HIN of FIG. 3) of the shutdown circuit unit 139 may be determined according to whether or not the output signal OS supplied from the shutdown comparison unit 135 is activated.

Specifically, when the output signal OS is activated, the shutdown circuit unit 139 may supply the second pulse signal that is in the off-state (i.e., PWM2-HIN that is at a low level (logical value of "0")) to the switch driving unit 150.

That is, the shutdown circuit unit 139 may turn off the first switching element S1 by supplying the second pulse signal that is in the off-state (i.e., PWM2-HIN of FIG. 3) to the switch driving unit 150.

On the other hand, when the output signal OS is deactivated, the shutdown circuit unit 139 may supply the second pulse signal that is in the on-state (i.e., PWM2-HIN that is at a high level (logic value of "1")) to the switch driving unit 150.

That is, the shutdown circuit unit 139 may turn on the first switching element S1 by supplying the second pulse signal that is in the on-state (i.e., PWM2-HIN of FIG. 3) to the switch driving unit 150.

The control unit 140 may control the shutdown circuit unit 139 and the switch driving unit 150.

Specifically, the control unit 140 may control the switch driving unit 150 by supplying the first pulse signal PWM1 to the shutdown circuit unit 139.

Further, the control unit 140 may receive the one or more output pulses OP from the count comparison unit 137.

Specifically, the control unit 140 may determine whether or not the object to be heated is present on the working coil WC based on the count or the on-duty time of the one or more output pulses OP supplied from the count comparison unit 137.

When it is determined that the object to be heated is present on the working coil WC, the control unit 140 may control the switch driving unit 150 to activate (i.e., drive) the corresponding working coil WC.

In some examples, the count may be the number of times at which the one or more output pulses OP are changed from the off-state to the on-state, and the on-duty time may be an accumulated time for the on-state of the one or more output pulses OP during the time when free resonance of the resonance current occurs (i.e., D3 of FIG. 4) in a current flow section including the working coil WC and the second switching element S2.

The control unit 140 may also display whether or not the object to be heated is sensed through a display unit or an input interface unit or may notify a user whether or not the object to be heated is sensed through a notification sound.

In some examples, the control unit 140 may include a micro controller configured to output a first pulse signal PWM1 having a constant magnitude (i.e., a single pulse (1-Pulse of FIG. 3)), but is not limited thereto.

The control unit 140 may also sense or receive (e.g., receive from the sensor 120) information about a voltage (e.g., input voltage) applied to the inverter unit 117, and may adjust a length of the single pulse (i.e., on-state duration time of the single pulse) based on a variation amount and the like of the received voltage, and details thereof will be described later.

The switch driving unit 150 may be driven based on a driver driving voltage supplied from an external power source, and may be connected to the inverter unit 117 to control a switching operation of the inverter unit 117.

Also, the switch driving unit 150 may control the inverter unit 117 based on the second pulse signal PWM2 supplied from the shutdown circuit unit 139. That is, the switch driving unit 150 may turn on or off the first and second switching elements S1 and S2 included in the inverter unit 117 based on the second pulse signal PWM2.

In some examples, the switch driving unit 150 may include first and second sub switch driving units configured to turn on or off the first and second switching elements S1 and S2, respectively. Details thereof are omitted.

Hereinafter, a method for sensing a container by the induction heating device of FIG. 2 will be described with reference to FIGS. 3 to 5.

Figure 3:
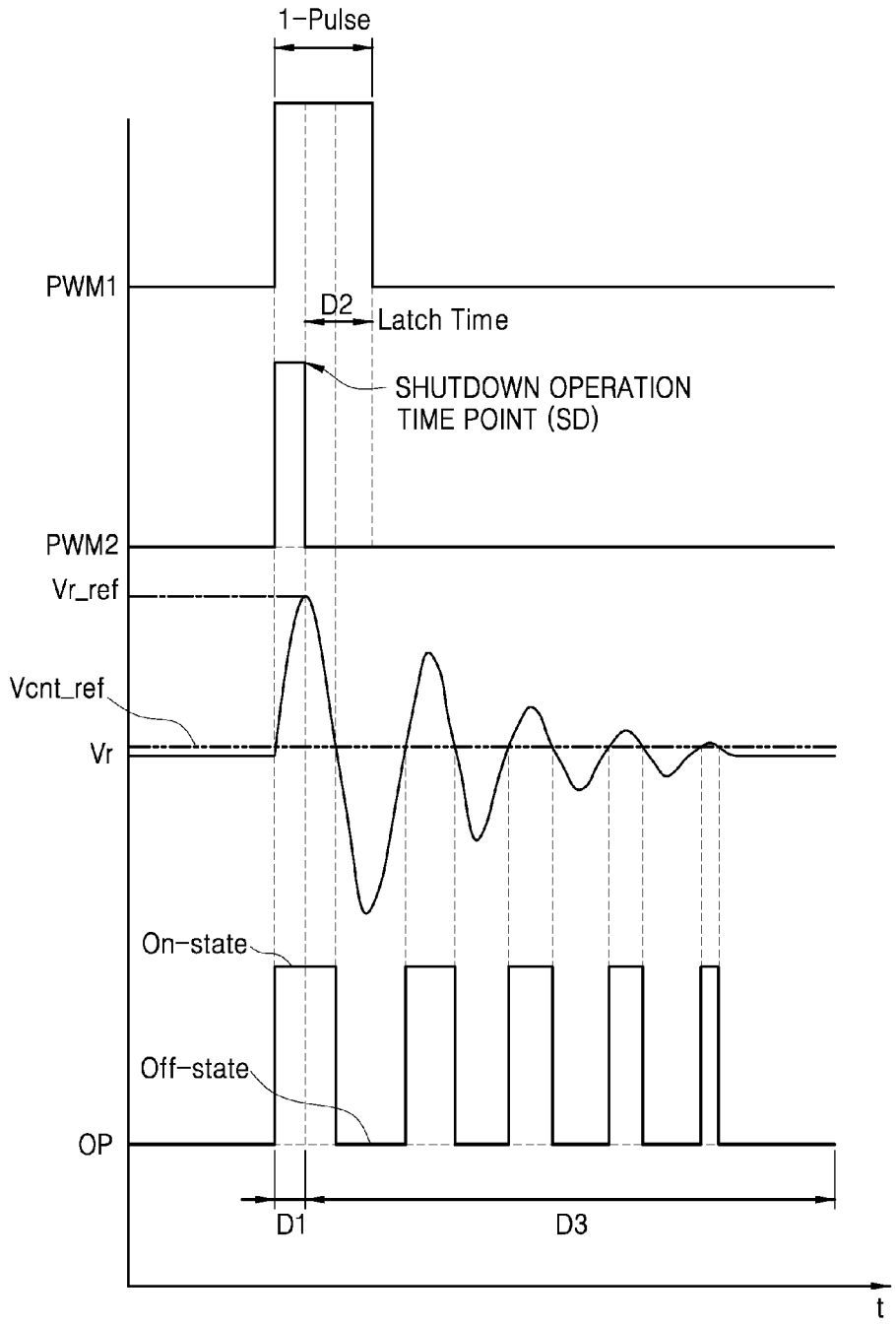
FIG. 3 is a graph illustrating an example method for sensing a container by the induction heating device of FIG. 2.

FIG. 3 is a graph illustrating a method for sensing a container by the induction heating device of FIG. 2. FIGS. 4 and 5 illustrate a method for sensing a container by the induction heating device of FIG. 2.

Figure 4:
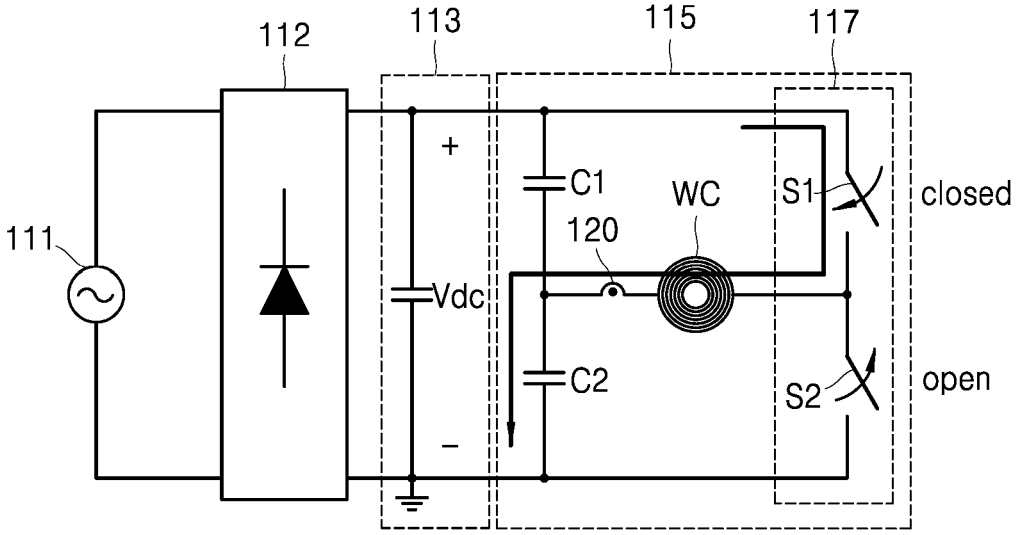
FIGS. 4 and 5 illustrate an example method for sensing a container by the induction heating device of FIG. 2.
Figure 5:
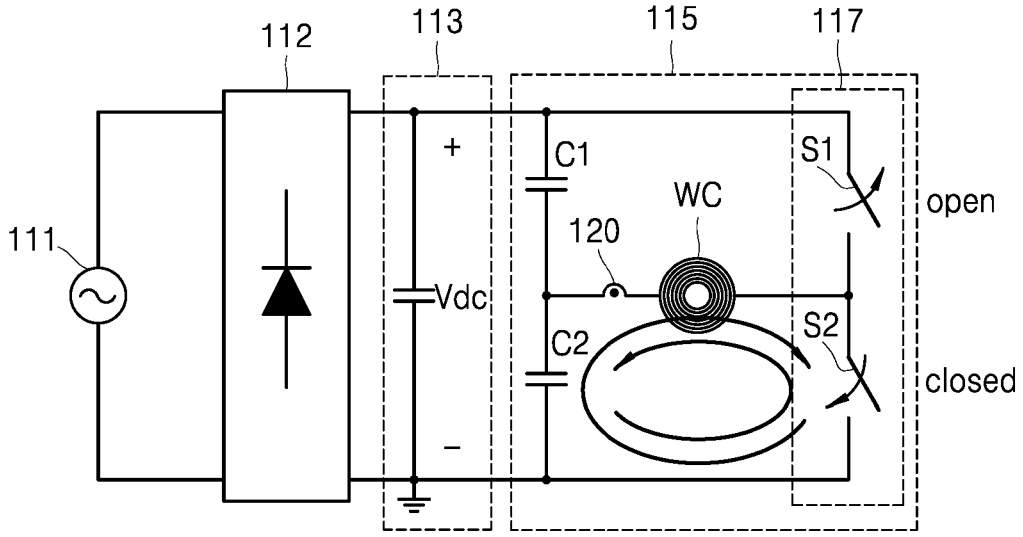

In some examples, in FIGS. 4 and 5, the above-described controller 180 is omitted for ease of explanation.

Referring to FIGS. 2 to 5, the control unit 140 may supply the first pulse signal PWM1 to the shutdown circuit unit 139. In some examples, the control unit 140 may supply a single pulse 1-Pulse to the shutdown circuit unit 139.

In some implementations, the shutdown circuit unit 139 may transmit the second pulse signal PWM2 to the switch driving unit 150 based on the single pulse 1-Pulse supplied from the control unit 140.

Here, as illustrated in FIGS. 3 and 4, while the second pulse signal PWM2 (i.e., PWM2-HIN) is inputted from the shutdown circuit unit 139, the switch driving unit 150 may turn on the first switching element S1 and turn off the second switching element S2.

In this process, the DC link capacitor 113 and the working coil WC to which the input voltage Vdc is applied may form a current flow section, and energy of the input voltage Vdc may be transmitted to the working coil WC. Accordingly, a current passing through the working coil WC may flow along the current flow section.

The sensor 120 may measure a current value Ir of the current passing through the working coil WC and transmit the measured current value Ir to the resonant current conversion unit 131. The resonant current conversion unit 131 may convert the measured current value Ir (current value before free resonance) to a voltage value Vr (i.e., first voltage value), and may supply the converted voltage value Vr to the shutdown comparison unit 135.

The shutdown comparison unit 135 may compare the voltage value Vr supplied from the resonant current conversion unit 131 with the predetermined resonance reference value Vr_ref.

In some implementations, when the supplied voltage value Vr is greater than the predetermined resonance reference value Vr_ref, the shutdown comparison unit 135 may supply the activated output signal OS to the shutdown circuit unit 139. A time point when the shutdown circuit unit 139 receives the activated output signal OS from the shutdown comparison unit 135 may correspond to a shutdown operation time point SD.

That is, the working coil WC may be charged with the input voltage Vdc during the period of time D1. In some implementations, when the working coil WC is sufficiently charged with the energy and exceeds a predetermined threshold value (i.e., predetermined resonance reference value Vr_ref), the shutdown circuit unit 139 may supply the second pulse signal PWM2 (i.e., PWM2-HIN) that is in the off-state to the switch driving unit 150 so that the working coil WC is no longer charged.

Accordingly, the shutdown circuit unit 139 may control the switch driving unit 150 so that a constant magnitude of energy is stored in the working coil WC. As a result, when the free resonance of the resonant current occurs in the current flow section including the working coil WC and the second switching element S2, the free resonance may constantly occur, thereby improving accuracy and reliability of a container sensing function.

In addition, after the shutdown operation time point SD, the latch circuit unit 133 may maintain the activation state of the output signal OS of the shutdown comparison unit 135 for a predetermined period of time D2 (i.e., latch time). This is to prevent the activated output signal OS from being deactivated while the first pulse signal PWM1 is inputted to the shutdown circuit unit 139.

As a result, when the output signal OS of the shutdown comparison unit 135 is activated once, the output signal OS of the shutdown comparison unit 135 may be maintained in an activated state for a predetermined period of time. Therefore, the shutdown circuit unit 139 may maintain the second pulse signal PWM2-HIN associated with the first switching element S1 in the off-state while the output signal OS is activated.

In some examples, when the second pulse signal PWM2 (i.e., PWM2-HIN) that is in the off-state is supplied from the shutdown circuit unit 139 to the switch driving unit 150 due to the activated output signal OS, the first switching element S1 may be turned off, and as a result, no more voltage (i.e., energy) may be charged in the working coil WC.

However, even when the first switching element S1 is turned off at the shutdown operation time point SD, the voltage supplied to the working coil WC may partially increase above the predetermined resonance reference value Vr_ref after the shutdown operation time point SD, and then may decrease.

In some examples, when the voltage supplied to the working coil WC falls below the predetermined resonance reference value Vr_ref or, the shutdown comparison unit 135 may receive a voltage value Vr less than the predetermined resonance reference value Vr_ref from the resonant current conversion unit 131, thereby deactivating the output signal OS.

In this case, the shutdown circuit unit 139 may supply the second pulse signal PWM2 (i.e., PWM2-HIN) that is in the on-state to the switch driving unit 150, and accordingly the first switching element S1 may be turned on. As a result, unnecessary energy may be further charged in the working coil WC that has already been charged.

In order to solve this problem, the latch circuit unit 133 may maintain the activation state of the output signal OS of the shutdown comparison unit 135 for a predetermined period of time D2 (i.e., latch time) after the shutdown operation time point SD.

In some implementations, as illustrated in FIGS. 3 and 5, the shutdown circuit unit 139 may turn off the first switching element S1 and turn on the second switching element S2 after the shutdown operation time point SD. As a result, the working coil WC, second capacitor C2, and second switching element S2 may form the current flow section.

After the current flow section is formed, the working coil WC may exchange energy with the capacitor C2, and a resonant current may flow while freely resonating in the current flow section.

Here, when the object to be heated is not present on the working coil WC, the amplitude of the resonant current may be attenuated by the resistance of the working coil WC.

On the other hand, when the object to be heated is present on the working coil WC, the amplitude of the resonant current may be attenuated (that is, more attenuated than when no object to be heated is present) by the resistance of the working coil WC and the resistance of the object to be heated.

In some implementations, the sensor 120 may measure a current value Ir of the current that resonates freely in the current flow section, and may supply the measured current value Ir to the resonant current conversion unit 131. The resonant current conversion unit 131 may convert the current value Ir (i.e., current value after free resonance) to a voltage value Vr (i.e., second voltage value), and may supply the converted voltage value Vr to the count comparison unit 137 and the control unit 140.

In some examples, a resistance value of the working coil WC may be constant, and thus the voltage has a waveform substantially the same to the current.

In some implementations, the count comparison unit 137 may compare the voltage value Vr with the predetermined count reference value Vcnt_ref and generate one or more output pulses OP based on a result of comparison. The count comparison unit 137 may also supply the one or more output pulses OP to the control unit 140.

Here, the one or more output pulses OP may have an on-state when the voltage value Vr is greater than the predetermined count reference value Vcnt_ref, and may have an off-state when the voltage value Vr is less than the predetermined count reference value Vcnt_ref.

The control unit 140 may determine whether or not the object to be heated is present on the working coil WC based on the one or more output pulses OP supplied from the count comparison unit 137.

For example, when a count of the one or more output pulses OP is less than a predetermined reference count, the control unit 140 may determine that the object to be heated is present on the working coil WC. On the other hand, when the count of the one or more output pulses OP is greater than the predetermined reference count, the control unit 140 may determine that no object to be heated is present on the working coil WC. Here, the count may be the number of times at which the one or more output pulses OP have changed from the off-state to the on-state.

In another example, when an on-duty time of the one or more output pulses OP is shorter than a predetermined reference time, the control unit 140 may determine that the object to be heated is present on the working coil WC. On the other hand, when the on-duty time of the one or more output pulses OP is longer than the predetermined reference time, the control unit 140 may determine that no object to be heated is present on the working coil WC. Here, the on-duty time may mean accumulated time for the on-state of the one or more output pulses OP during a period of time (i.e., D3) after the shutdown operation time point SD.

That is, the control unit 140 may accurately determine whether or not the object to be heated is present by using the count or on-duty time of the one or more output pulses OP.

In some implementations, when it is determined that the object to be heated is present on the working coil WC, the control unit 140 may activate the corresponding working coil WC. In addition, the control unit 140 may display whether or not the object to be heated is sensed through a display unit or an interface unit, or may notify the user whether or not the object to be heated is sensed by generating an alarm sound.

Figure 6:
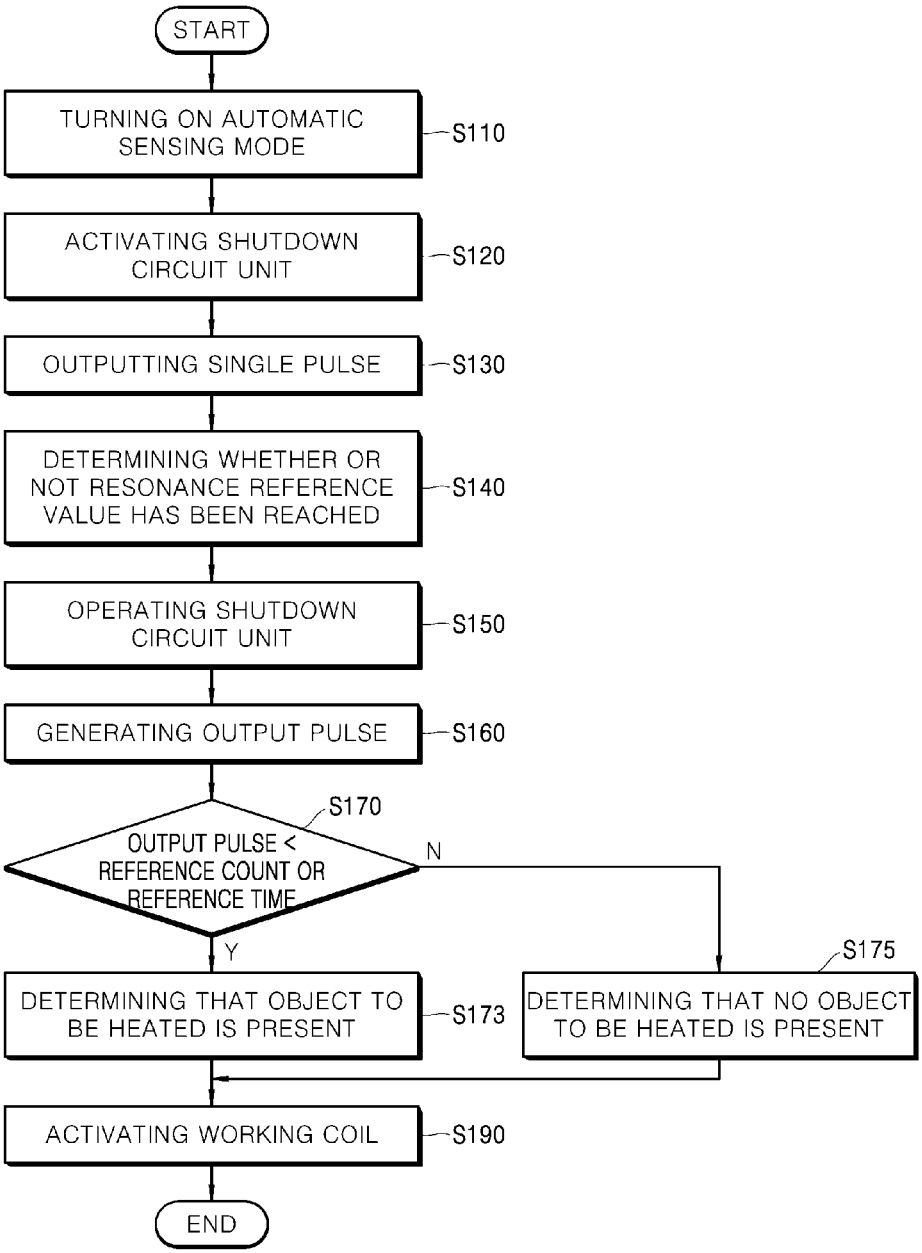
FIG. 6 is a flowchart illustrating an example method for sensing a container.

FIG. 6 is a flowchart illustrating a method for sensing a container according to an implementation of the present disclosure.

Referring to FIGS. 2 and 6, in the method for sensing a container according to an implementation of the present disclosure, an automatic container sensing mode may be manually turned on or off by the user, but is not limited thereto. That is, the automatic container sensing mode may be automatically turned on when a power source of the induction heating device is turned on, and may be automatically turned off when the power source thereof is turned off.

In some implementations, when the automatic container sensing mode is turned on, the shutdown circuit unit 139 may be activated (S120). In some implementations, when the shutdown circuit unit 139 is activated, the control unit 140 may output a single pulse (PWM1 of FIG. 3; that is, 1-Pulse) to charge the working coil WC with energy (S130). In some examples, the shutdown circuit unit 139 may control the switch driving unit 150 based on the single pulse supplied from the control unit 140 and the above-described output signal (OS of FIG. 2).

In some examples, the control unit 140 may output single pulses having different lengths according to a magnitude or variation amount of the input voltage Vdc. Details thereof will be described later.

In some implementations, the working coil WC may be charged with the energy of the input voltage Vdc. The sensor 120 may measure a current value Ir of the current flowing through the working coil WC. The resonant current conversion unit 131 may convert the current value Ir measured by the sensor 120 into a voltage value Vr (i.e., first voltage value).

In some implementations, the shutdown comparison unit 135 may determine whether or not the voltage value Vr received from the resonant current conversion unit 131 reaches the predetermined resonance reference value Vr_ref (S140).

In some implementations, when the received voltage value Vr reaches the predetermined resonance reference value Vr_ref, the output signal OS of the shutdown comparison unit 135 may be activated.

In some implementations, the shutdown circuit unit 139 may operate based on the activated output signal OS (S150). In some examples, the shutdown circuit unit 139 may control the switch driving unit 150 so that the current applied to the working coil WC freely resonates. That is, the shutdown circuit unit 139 may form the current flow section in the induction heating unit 115 by controlling the inverter unit 117 through the switch driving unit 150.

In some implementations, the sensor 120 may measure the current value Ir of the current that resonates freely in the current flow section, and transmit the measured current value Ir to the resonant current conversion unit 131. The resonant current conversion unit 131 may convert the current value Ir into a voltage value Vr (i.e., second voltage value). The converted voltage value Vr may be transmitted to the count comparison unit 137 and the control unit 140.

In some implementations, the count comparison unit 137 may generate the one or more output pulses OP based on a result of comparing the voltage value Vr with the predetermined count reference value Vcnt_ref (S160).

Here, the one or more output pulses OP may have an on-state when the voltage value Vr is greater than the predetermined count reference value Vcnt_ref, and may have an off-state when the voltage value Vr is less than the predetermined count reference value Vcnt_ref.

The count comparison unit 137 may supply the one or more output pulses OP to the control unit 140.

In some implementations, the control unit 140 may compare the count of the one or more output pulses OP received from the count comparison unit 137 with a predetermined reference count or compare the on-duty time with a predetermined reference time (S170).

In some implementations, when the count of the one or more output pulses OP is less than the predetermined reference count or the on-duty time is shorter than the predetermined reference time, the control unit 140 may determine that the object to be heated is present on the working coil WC (S173).

Conversely, when the count of the one or more output pulses OP is greater than the predetermined reference count or the on-duty time is longer than the predetermined reference time, the control unit 140 may determine that no object to be heated is present on the working coil WC (S175).

In some implementations, the control unit 140 may activate the working coil in which the object to be heated is sensed (S190). In some examples, the control unit 140 may display whether the object to be heated is sensed through the display unit or interface unit or notify the user whether the object to be heated is sensed through a notification sound. In some examples, this configuration is merely one example, and the control unit 140 may notify the user whether or not the object to be heated is present in various ways.

Figure 7A:
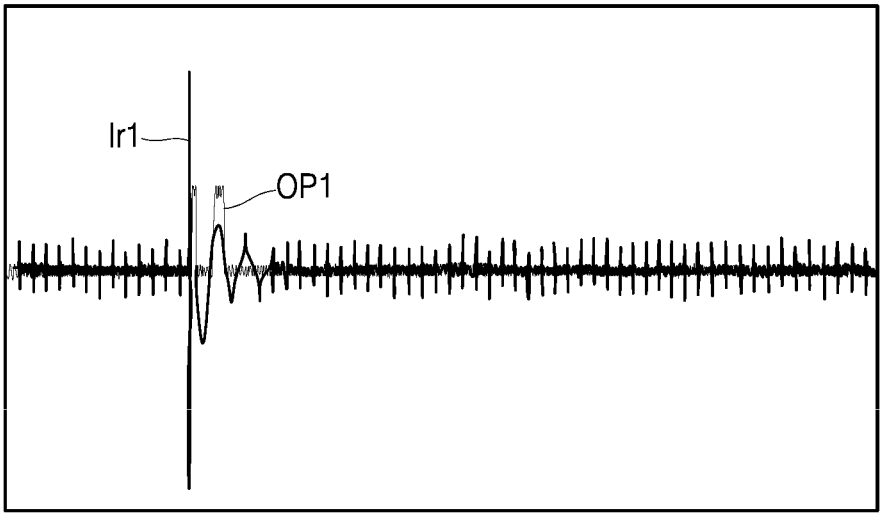
FIGS. 7A and 7B are graphs illustrating example waveforms that may be used according to the method of FIG. 6 to determine whether or not an object to be heated is present.
Figure 7B:
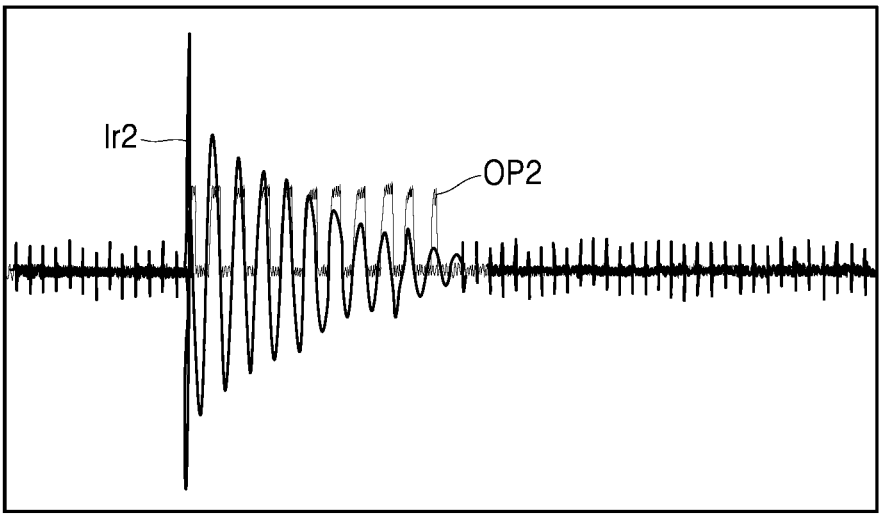

FIGS. 7A and 7B are graphs illustrating example waveforms that can be used according to the method of FIG. 6 to determine whether or not the object to be heated is present.

FIG. 7A illustrates a waveform used when the object to be heated is disposed on the working coil WC, and FIG. 7B illustrates a waveform used when the object to be heated is not disposed on the working coil WC. But, FIGS. 7A and 7B illustrate merely one experimental example, and the implementations of the present disclosure are not limited to the experimental example of FIGS. 7A and 7B.

Here, FIG. 7A illustrates a first resonant current Ir1 flowing through a working coil (WC of FIG. 2) and a first one or more output pulses OP1 for the first resonant current Ir1. FIG. 7B illustrates a second resonant current Ir2 flowing through the working coil (WC of FIG. 2) and a second one or more output pulses OP2 for the second resonant current Ir2.

Referring to FIGS. 2, 7A, and 7B, a count of the first one or more output pulses OP1 is twice in FIG. 7A, and a count of the second one or more output pulses OP2 is eleventh in FIG. 7B. That is, the count may be relatively small in number when the object to be heated is disposed on the working coil WC, and the count may be relatively large in number when the object to be heated is not disposed on the working coil WC.

Therefore, a reference count for determining whether or not the object to be heated is present on the working coil WC may be determined as a value between the count of FIG. 7A and the count of FIG. 7B. Further, the control unit 140 may determine whether or not the object to be heated is present on the working coil WC by using a predetermined reference count.

Also, an on-duty time of the first one or more output pulses OP1 illustrated in FIG. 7A may be shorter than an on-duty time of the second one or more output pulses OP2 illustrated in FIG. 7B. That is, the on-duty time may be relatively short when the object to be heated is disposed on the working coil WC, and the on-duty time may be relatively long when the object to be heated is not disposed on the working coil WC.

Therefore, a reference time for determining whether or not the object to be heated is present on the working coil may be determined as a value between the on-duty time of FIG. 7A and the on-duty time of FIG. 7B. Further, the control unit 140 may determine whether or not the object to be heated is present on the working coil WC by using a predetermined reference time.

That is, the control unit 140 may improve accuracy of determination as to whether or not the object to be heated is present on the working coil WC by using at least one of the count and on-duty time of the one or more output pulses OP.

Figure 8:
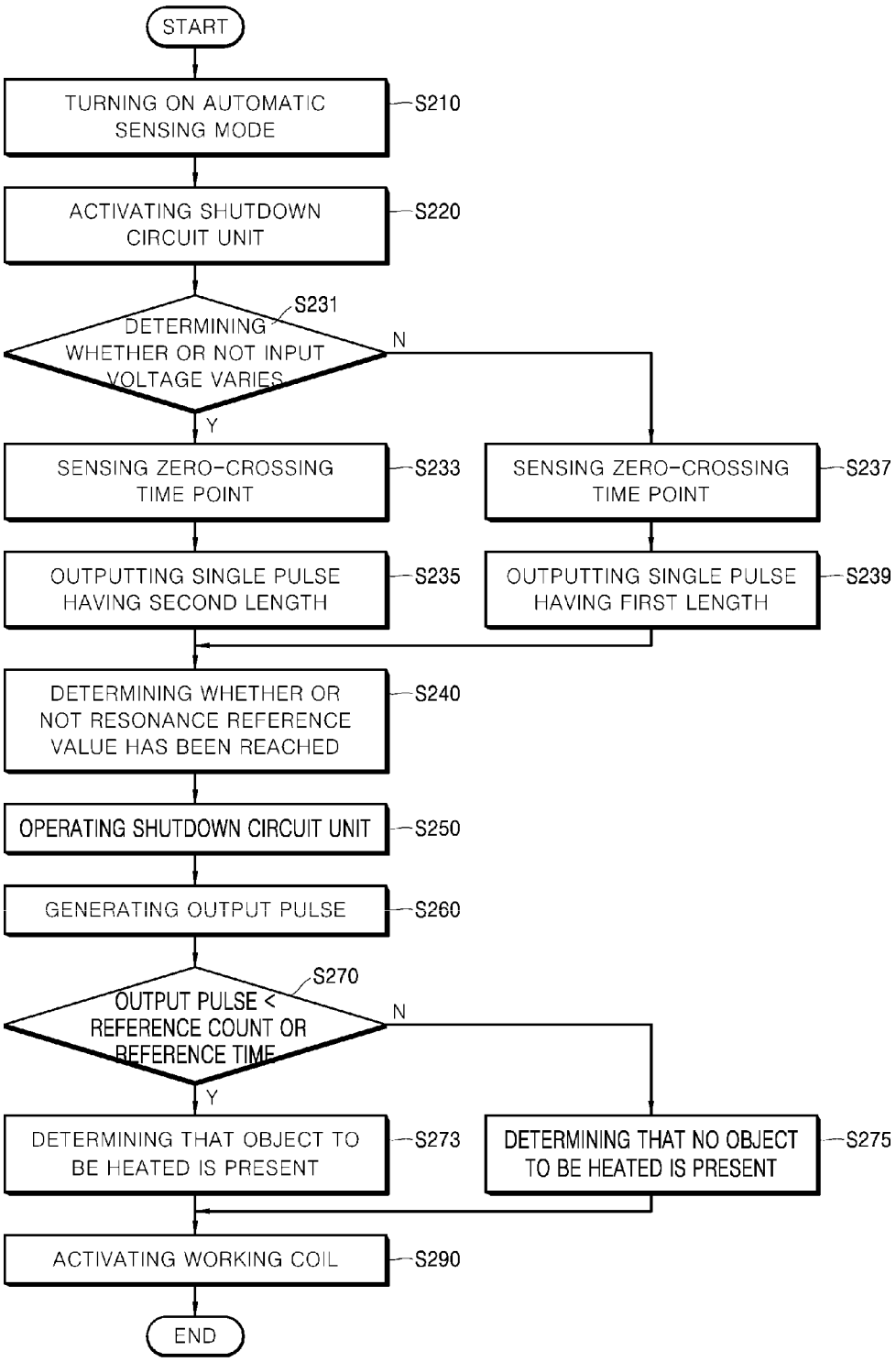
FIG. 8 is a flowchart illustrating an example method for sensing a container according to another implementation of the present disclosure.

FIG. 8 is a flowchart illustrating an example method for sensing a container according to another implementation of the present disclosure. Hereinafter, a configuration overlapping with the above-described configuration of FIG. 6 will be omitted and a difference therebetween will be mainly described.

Referring to FIGS. 2 and 8, in some implementations, the automatic container sensing mode of the induction heating device may be turned on (S110).

In some implementations, when the automatic container sensing mode is turned on, the shutdown circuit unit 139 may be activated (S220).

In some implementations, the control unit 140 may determine whether or not the input voltage Vdc inputted to the induction heating unit 115 varies (S231). In some examples, the control unit 140 may determine whether or not the input voltage Vdc varies in consideration of a magnitude and variation amount of the input voltage Vdc. Details thereof will be given below.

In some implementations, the control unit 140 may sense a zero-crossing time point of the input voltage Vdc (S223 and S237). Also, the control unit 140 may determine whether or not a cooking container is present on the working coil WC in a section in which the input voltage Vdc is lower than a predetermined reference voltage based on the zero-crossing time point. That is, the control unit 140 may perform the container sensing operation only in a section in which the input voltage Vdc is lower than the reference voltage.

Details of the zero-crossing time point will be given below.

In some implementations, when the variation amount of the input voltage Vdc is greater than a predetermined variation reference value, the control unit 140 may output a single pulse having a second length (S235). Here, the variation reference value means a value for determining whether or not another induction heating unit operates.

On the other hand, when the variation amount of the input voltage Vdc is less than the predetermined variation reference value, the control unit 140 may output a single pulse having a first length shorter than the second length (S239).

In some implementations, steps S240 to S290 are substantially the same as the steps S140 to S190 described above with reference to FIG. 6, and thus details thereof are omitted.

Hereinafter, a case where the input voltage varies in the induction heating device will be described in detail with reference to FIGS. 9 to 12B.

Figure 9:
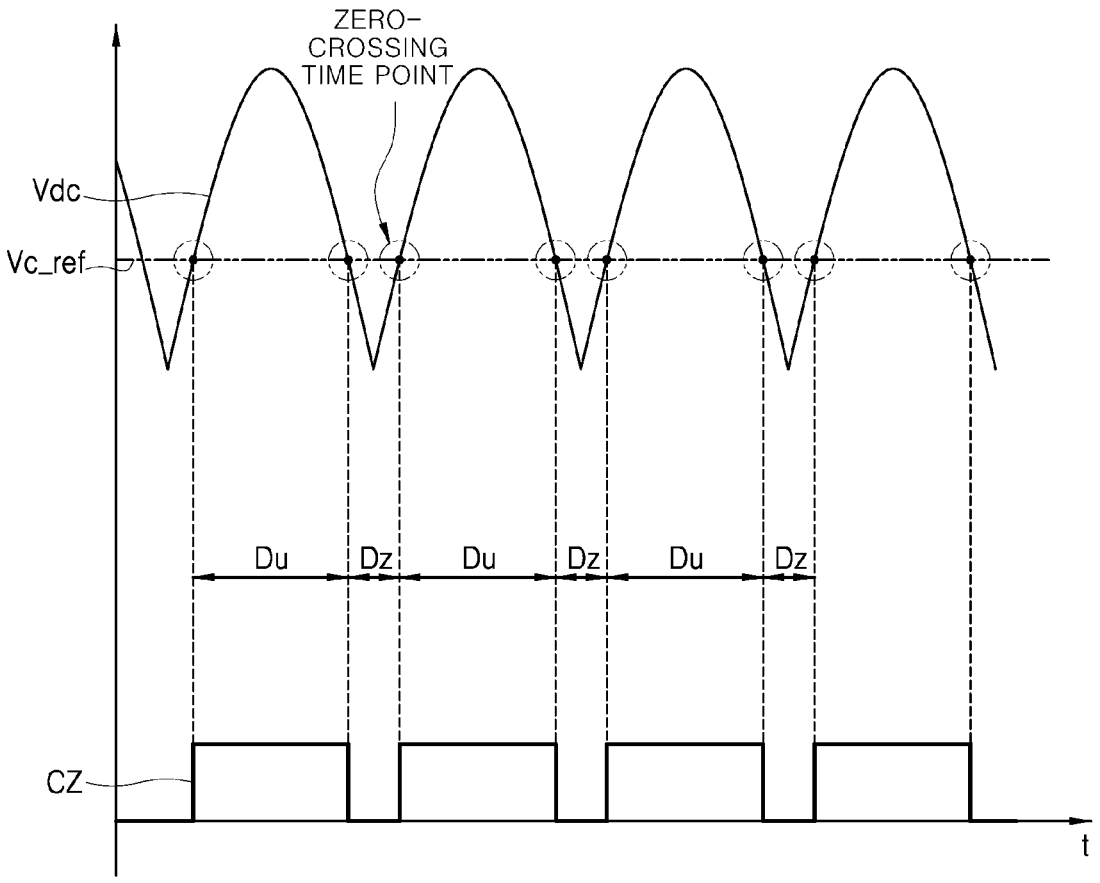
FIG. 9 is a graph illustrating example zero-crossing time points of FIG. 8.

FIG. 9 is a graph illustrating example zero-crossing time points of FIG. 8.

FIG. 9 illustrates a rectified input voltage Vdc and a zero-voltage detection waveform CZ for the input voltage Vdc.

Referring to FIGS. 2 and 9, the input voltage Vdc may have a half-wave rectified waveform due to a rectifying operation of the rectification unit 112. For example, the input voltage Vdc may have a half-wave rectified waveform that varies on the basis of about 150V.

A time point at which the input voltage Vdc becomes equal to a predetermined reference voltage Vc_ref is referred to as a zero-crossing time point (i.e., zero-voltage time point).

Based on the zero-crossing time point, the input voltage Vdc may be divided into a first section Dz in which the input voltage Vdc is lower than the predetermined reference voltage Vc_ref and a second section Du in which the input voltage Vdc is higher than the predetermined reference voltage Vc_ref.

A variation amount of the input voltage Vdc occurring in the first section Dz may be relatively smaller than a variation amount of the input voltage Vdc occurring in the second section Du. Therefore, the control unit 140 may perform a relatively stable container sensing operation in the first section Dz.

Accordingly, the control unit 140 may perform the container sensing operation only in the first section Dz in which the input voltage Vdc is less than the predetermined reference voltage Vc_ref.

For this purpose, the control unit 140 may sense a zero-crossing time point of the input voltage Vdc and determine whether or not the object to be heated is present on the working coil WC in a section in which the input voltage Vdc is less than the reference voltage Vc_ref based on the zero-crossing time point.

As a result, the container sensing operation may be performed only in the first section Dz, thereby improving the accuracy and reliability of the induction heating device 100 in sensing a container.

FIGS. 10 to 12B illustrate examples of a container sensing operation that may vary based on whether or not an input voltage of FIG. 8 varies.

Figure 10:
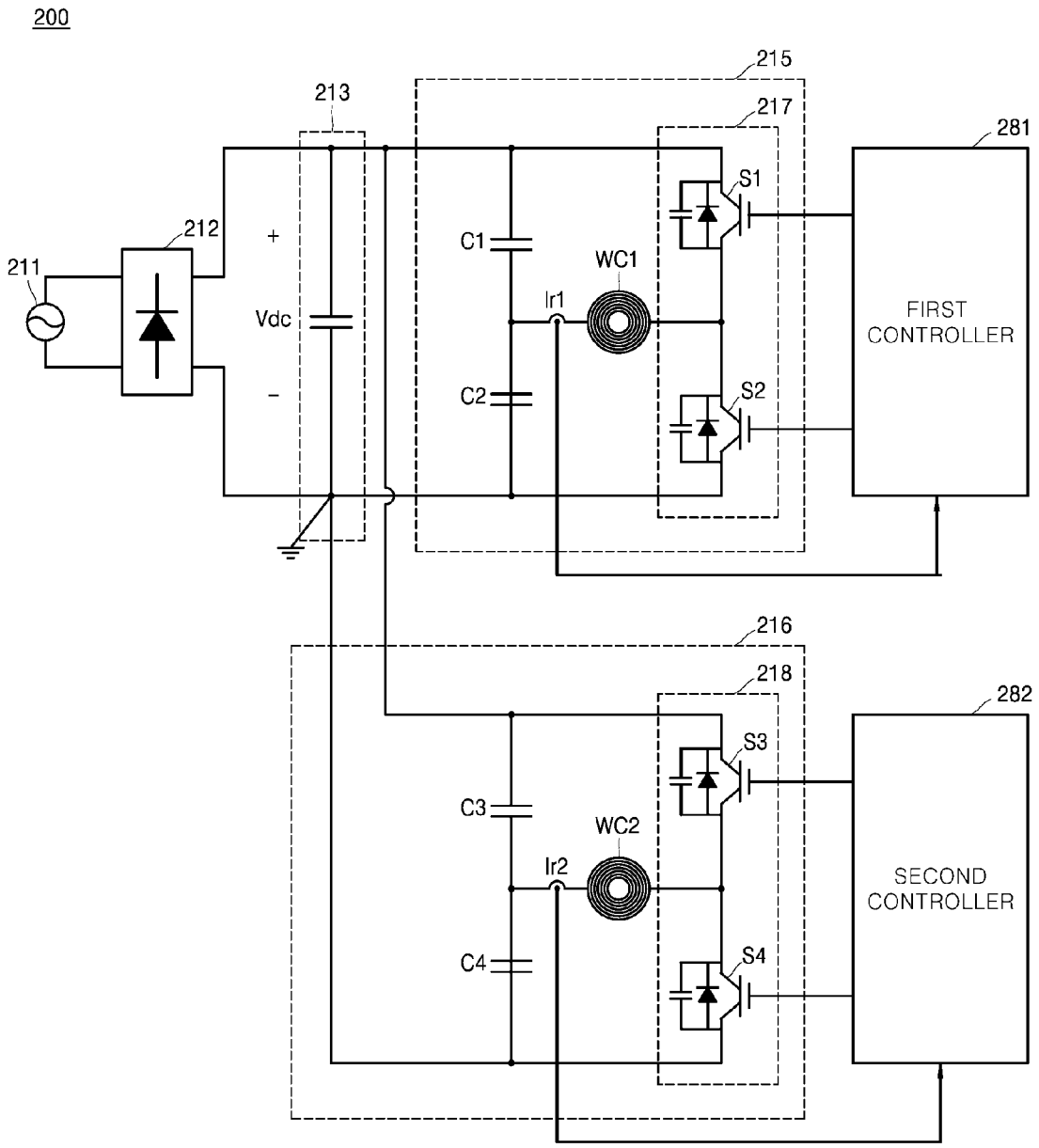
FIGS. 10 to 12B illustrate examples of a container sensing operation based on an input voltage of FIG. 8.

In some examples, the induction heating device 200 of FIG. 10 may be different from the induction heating device 100 of FIG. 2 described above. In some cases, the induction heating device 200 of FIG. 10 may include some or all features or components of the induction heating device 100 of FIG. 2 described above.

Referring to FIG. 10, the induction heating device 200 may include a first induction heating unit 215 and a second induction heating unit 216. The first induction heating unit 215 and the second induction heating unit 216 may share the same input voltage Vdc. In some examples, the first induction heating unit 215 and the second induction heating unit 216 may be disposed adjacent to each other.

The first induction heating unit 215 may be controlled by a first controller 281 and the second induction heating unit 216 may be controlled by a second controller 282.

The first induction heating unit 215 and the second induction heating unit 216 may have substantially the same configuration as the above-described induction heating unit (115 of FIG. 2). In addition, the first controller 281 and the second controller 282 may have substantially the same configuration as the above-described controller (180 of FIG. 2). Details of the induction heating unit 115 and the controller 180 have been described above, and thus are omitted.

When the second induction heating unit 216 operates, an organic current may occur in the first induction heating unit 215.

Figure 11:
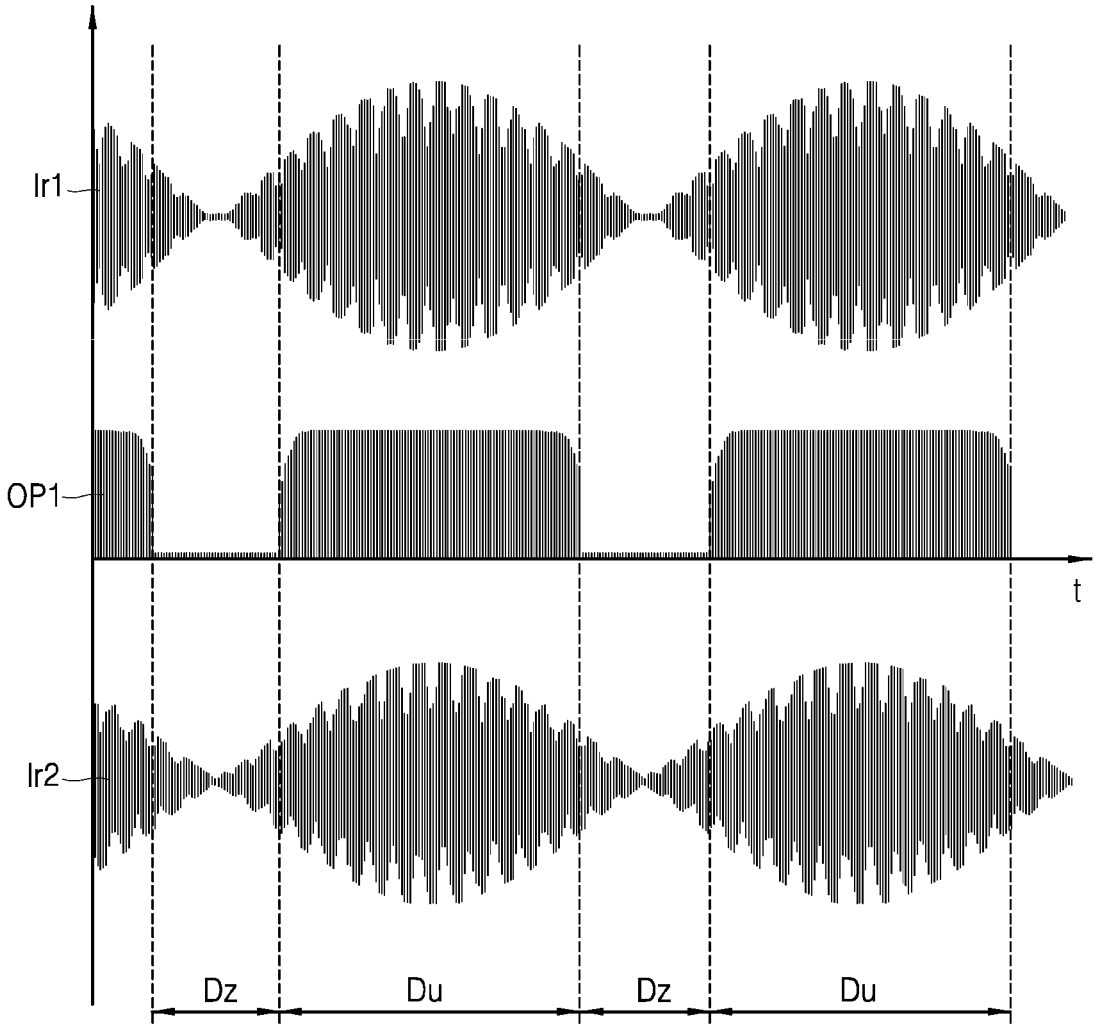

In FIG. 11, a second current Ir2 represents a current flowing through a second working coil WC2 when the second induction heating unit 216 operates. A first current Ir1 represents a current which is induced to a first working coil WC1 as the second induction heating unit 216 operates. A comparator output OP1 represents one or more output pulses outputted from the count comparison unit by the first current Ir1.

Referring to the graph of FIG. 11, the first current Ir1 may be divided into a first section Dz in which a magnitude of the first current Ir1 is smaller than a predetermined magnitude of current, and a second section Du in which the magnitude of the first current Ir1 is larger than the predetermined magnitude of current. In some examples, a boundary point between the first section Dz and the second section Du may correspond to the zero-crossing time point.

Here, it can be seen that, in the first section Dz, the comparator output OP1 is not outputted since the magnitude of the first current Ir1 induced by the operation of the second induction heating unit 216 is small.

The first controller 281 may perform the container sensing operation in the first section Dz. In other words, a control unit included in the first controller 281 may perform the container sensing operation in a section in which a current induced to the first working coil WC1 is less than a predetermined reference current (i.e., first section Dz).

As a result, the method for sensing a container may be less influenced by the operation of another working coil, thereby improving the accuracy and reliability of the container sensing operation.

Figure 12A:
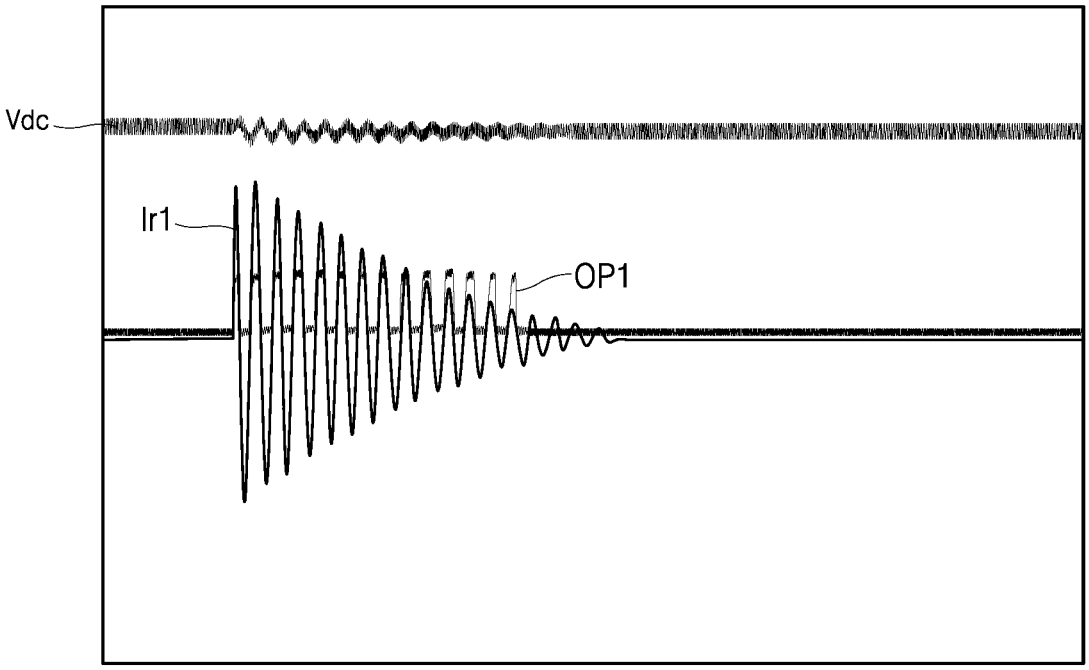
Figure 12B:
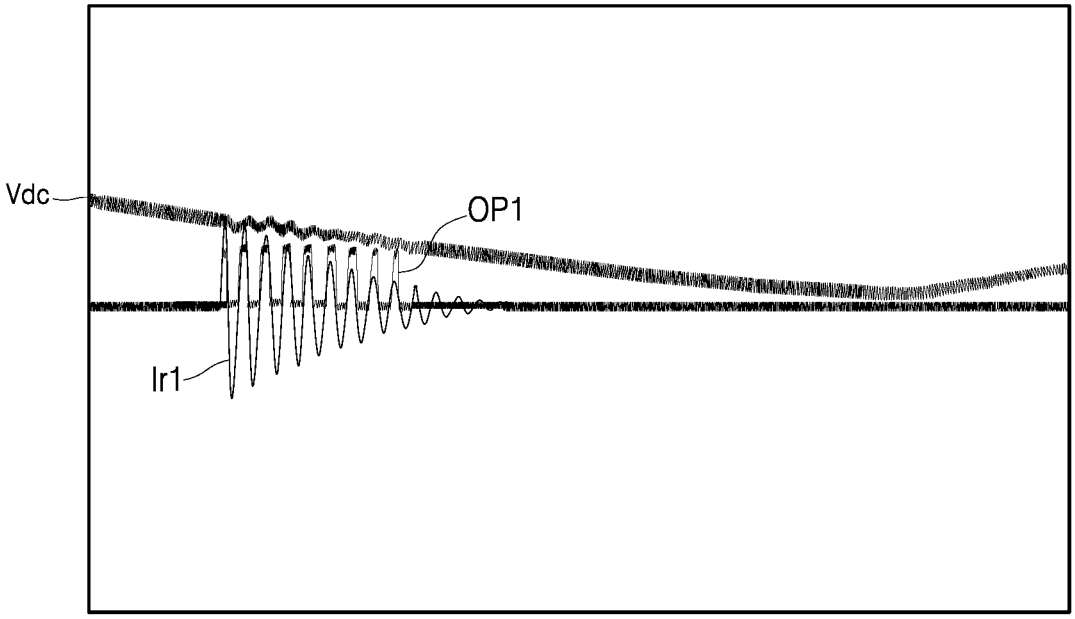

FIG. 12A is a graph illustrating an example waveform appearing in the first induction heating unit 215 when the second induction heating unit 216 does not operate. FIG. 12B is a graph illustrating an example waveform appearing in the first induction heating unit 215 when the second induction heating unit 216 operates.

In FIG. 12A, an input voltage Vdc having a constant magnitude may be applied to the first induction heating unit 215.

In FIG. 12B, an unstable input voltage Vdc may be applied to the first induction heating unit 215. This is a phenomenon occurring when the first induction heating unit 215 and the second induction heating unit 216 share the input voltage Vdc. The second induction heating unit 216 may use a part of the power supplied from the input voltage Vdc, and thus the magnitude of the input voltage Vdc applied to the first induction heating unit 215 may become smaller.

Therefore, when the input voltage Vdc having a constant magnitude is applied as illustrated in FIG. 12A, the control unit may transmit a single pulse having a relatively short first length (for example, 1-Pulse of FIG. 4) to a shutdown circuit unit. This is because a pulse having the first length is sufficient to charge the working coil WC.

When the unstable input voltage Vdc having a relatively small magnitude is applied as illustrated in FIG. 12B, the control unit may transmit a pulse having a second length longer than the first length to the shutdown circuit unit. This is to stably charge the working coil WC by applying a pulse having the second length longer than the first length.

In addition, the control unit may compare the variation amount of the input voltage Vdc with a predetermined variation reference value and determine a length of a single pulse to be supplied to the shutdown circuit unit based on a result of comparison.

Specifically, when the variation amount of the input voltage Vdc is greater than the predetermined variation reference value, the control unit may output a single pulse having the second length. Here, the variation reference value means a value for determining whether or not another induction heating unit operates.

For example, when the first and second induction heating units 215 and 216 share the input voltage Vdc and the second induction heating unit 216 operates, the variation amount of the input voltage Vdc applied to the first induction heating unit 215 may increase (FIG. 12B). In this case, the control unit 140 may output a pulse having the second length that is relatively long.

When the variation amount of the input voltage Vdc is less than the predetermined variation reference value, the control unit 140 may output a single pulse having the first length shorter than the second length.

That is, a container sensing unit may generate a constant magnitude of resonant current in the working coil WC through the above-described method, thereby improving accuracy in determining that a container is sensed.

In some implementations, it may be possible to reduce power consumption and improve a response characteristic through the method for sensing a container by the induction heating device, thereby preventing waste of electric power and improving a user's satisfaction.

In some implementations, it may be possible to stably perform the container sensing operation regardless of whether or not an adjacent working coil operates or a change in input power through the method for sensing a container by the induction heating device, thereby improving the accuracy and operation reliability of the container sensing function. In addition, the method for sensing a container by the induction heating device may prevent an over-current from flowing when performing the container sensing function, thereby preventing a noise resulting from the over-current.

It should be understood that these implementations are given by way of illustration only and do not limit the scope of the present disclosure, and that various modifications, variations, and alterations can be made without departing from the spirit and scope of the present disclosure defined only by the accompanying claims and equivalents thereof.

What is claimed is:

1. A method for sensing a container by an induction heating device that includes a switch driving unit, an induction heating circuit configured to drive a working coil by an inverter unit, a sensor configured to sense current applied to the induction heating circuit, a resonant current conversion unit configured to convert current values to voltage values, a shutdown comparison unit, a shutdown circuit unit configured to control the switch driving unit, a count comparison unit, and a control unit configured to determine presence of the container on the working coil, the method comprising:

charging, by controlling the inverter unit through the switch driving unit, the induction heating circuit;

sensing, by the sensor, a current applied to the induction heating circuit;

converting, by the resonant current conversion unit, a current value of the current into a first voltage value;

comparing, by the shutdown comparison unit, the first voltage value with a predetermined resonance reference value;

based on the first voltage value being greater than the predetermined resonance reference value, generating a resonance of the current by controlling the switch diving unit through the shutdown circuit unit;

based on generation of the resonance, sensing, by the sensor, a resonant current generated in the induction heating circuit;

converting, by the resonant current conversion unit, a current value of the resonant current into a second voltage value;

comparing, by the count comparison unit, the second voltage value with a predetermined count reference value;

generating, by the count comparison unit, one or more output pulses based on a result of the comparison of the second voltage value with the predetermined count reference value;

comparing, by the control unit, a count of the one or more output pulses with a predetermined reference count, or comparing, by the control unit, an on-duty time of the one or more output pulses with a predetermined reference time; and based on (i) a result of the comparison of the count of the one or more output pulses with the predetermined reference count or (ii) a result of the comparison of the on-duty time of the one or more output pulses with the predetermined reference time, determining, by the control unit, whether or not an object is present on the working coil.

2. The method of claim 1, wherein controlling the inverter unit comprises:

based on a switching signal supplied from the switch driving unit, turning on and turning off a first switching element and a second switching element of the inverter unit.

3. The method of claim 2, wherein charging the induction heating circuit comprises:

charging the induction heating circuit based on turning on the first switching element and turning off the second switching element.

4. The method of claim 2, wherein generating the resonance of the current comprises:

generating the resonance of the current based on turning off the first switching element and turning on the second switching element.

5. The method of claim 1, wherein generating the resonance of the current comprises:

maintaining an output signal of the shutdown comparison unit in an activated state for a predetermined period of time.

6. The method of claim 1, wherein generating the one or more output pulses comprises:

generating a pulse corresponding to an on-state based on the second voltage value being greater than the predetermined count reference value; and generating a pulse corresponding to an off-state based on the second voltage value being less than the predetermined count reference value.

7. The method of claim 6, further comprising:

determining the count based on a number of times at which the one or more output pulses are switched from the off-state to the on-state, wherein determining whether or not the object is present on the working coil comprises:

determining that the object is present on the working coil based on the count being less than the predetermined reference count, and determining that the object is not present on the working coil based on the count being greater than the predetermined reference count.

8. The method of claim 6, further comprising:

determining the on-duty time based on an accumulated time of the on-state of the one or more output pulses, wherein determining whether or not the object is present on the working coil comprises:

determining that the object to be heated is present on the working coil based on the on-duty time being less than the predetermined reference time, and determining that the object is not present on the working coil based on the on-duty time being greater than the predetermined reference time.

9. The method of claim 1, further comprising:

receiving, at the control unit, a voltage applied to the inverter unit;

outputting, from the control unit, a first single pulse having a first on-state duration based on a variation amount of the voltage being less than a predetermined variation reference value; and outputting, from the control unit, a second single pulse having a second on-state duration greater than the first on-state duration based on the variation amount of the voltage being greater than the predetermined variation reference value.

10. The method of claim 9, wherein charging the inducting heating circuit comprises:

supplying a single pulse having the first on-state duration or the second on-state duration to the shutdown circuit unit.

11. The method of claim 1, wherein determining whether or not the object is present on the working coil comprises:

determining whether or not the object is present on the working coil in a state in which a voltage applied to the inverter unit is less than a predetermined reference voltage.

12. The method of claim 1, wherein determining whether or not the object is present on the working coil comprises:

based on an induction current induced to the working coil by operation of another working coil disposed within a range from the working coil, determining whether or not the object is present on the working coil in a state in which the induction current is less than a predetermined reference current.

13. The method of claim 2, further comprising:

generating, by the shutdown comparison unit, an output signal based on the first voltage value being greater than the predetermined resonance reference value.

14. The method of claim 13, further comprising:

supplying a pulse signal to the shutdown circuit unit; and based on the pulse signal, transmitting the output signal from the shutdown circuit unit to the switch driving unit.

15. The method of claim 14, further comprising:

generating, by the switch driving unit, the switching signal based on the output signal received from the shutdown circuit unit.

16. The method of claim 1, wherein charging the inducting heating circuit comprises charging the inducting heating circuit with energy having a constant magnitude.

17. A method for sensing a container by an induction heating device that includes a switch driving unit, an induction heating circuit configured to drive a working coil by an inverter unit, a sensor configured to sense current applied to the induction heating circuit, a resonant current conversion unit configured to convert current values to voltage values, a shutdown comparison unit, a shutdown circuit unit configured to control the switch driving unit, a count comparison unit, and a control unit configured to determine presence of the container on the working coil, the method comprising:

charging, by controlling the inverter unit through the switch driving unit, the induction heating circuit;

sensing, by the sensor, a current applied to the induction heating circuit;

converting, by the resonant current conversion unit, a current value of the current into a first voltage value;

comparing, by the shutdown comparison unit, the first voltage value with a predetermined resonance reference value;

based on the first voltage value being greater than the predetermined resonance reference value, generating a resonance of the current by controlling the switch diving unit through the shutdown circuit unit;

based on generation of the resonance, sensing, by the sensor, a resonant current applied to the induction heating circuit;

converting, by the resonant current conversion unit, a current value of the resonant current measured by the sensor into a second voltage value;

comparing, by the count comparison unit, the second voltage value with a predetermined count reference value;

generating, by the count comparison unit, one or more output pulses based on a result of the comparison of the second voltage value with the predetermined count reference value;

comparing, by the control unit, a count of the one or more output pulses with a predetermined reference count, or comparing, by the control unit, an on-duty time of the one or more output pulses with a predetermined reference time; and based on (i) a result of the comparison of the count of the one or more output pulses with the predetermined reference count or (ii) a result of the comparison of the on-duty time of the one or more output pulses with the predetermined reference time, determining, by the control unit, whether or not an object is present on the working coil, wherein charging the inducting heating circuit comprises:

receiving, at the control unit, a voltage applied to the inverter unit, outputting, from the control unit, a first single pulse having a first on-state duration based on a variation amount of the voltage being less than a predetermined variation reference value, and outputting, from the control unit, a second single pulse having a second on-state duration greater than the first on-state duration based on the variation amount of the voltage being greater than the predetermined variation reference value.

18. The method of claim 17, wherein generating the one or more output pulses comprises:

generating a pulse corresponding to an on-state based on the second voltage value being greater than the predetermined count reference value, and generating a pulse corresponding to an off-state based on the second voltage value being less than the predetermined count reference value.

19. The method of claim 18, further comprising:

determining the count based on a number of times at which the one or more output pulses are switched from the off-state to the on-state, wherein determining whether or not the object is present on the working coil comprises:

determining that the object is present on the working coil based on the count being less than the predetermined reference count, and determining that the object is not present on the working coil based on the count being greater than the predetermined reference count.

20. The method of claim 18, further comprising:

determining the on-duty time based on an accumulated time for the on-state of the one or more output pulses, wherein determining whether or not the object is present on the working coil comprises:

determining that the object to be heated is present on the working coil based on the on-duty time being less than the predetermined reference time, and determining that the object is not present on the working coil based on the on-duty time being greater than the predetermined reference time.

* * * * *